US011373607B2

(12) United States Patent
Su et al.

(10) Patent No.: US 11,373,607 B2
(45) Date of Patent: Jun. 28, 2022

(54) DISPLAY DEVICE AND DRIVING METHOD THEREOF FOR REDUCING FLICKER DUE TO REFRESH RATE VARIATION

(71) Applicant: NOVATEK MICROELECTRONICS CORP., Hsinchu (TW)

(72) Inventors: Yu-Hung Su, Hsinchu (TW); Vans Shih, Hsinchu (TW); Yen-Tao Liao, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 85 days.

(21) Appl. No.: 16/820,427

(22) Filed: Mar. 16, 2020

(65) Prior Publication Data

US 2021/0287619 A1 Sep. 16, 2021

(51) Int. Cl.
*G09G 3/36* (2006.01)

(52) U.S. Cl.
CPC ..... *G09G 3/36* (2013.01); *G09G 2320/0247* (2013.01)

(58) Field of Classification Search
CPC ..... G09G 3/36; G09G 2320/0247; G09G 2310/061
See application file for complete search history.

(56) References Cited

U.S. PATENT DOCUMENTS 10,380,947 B2 8/2019 Fujii et al.
11,322,106 5/2022 Chen et al.
2012/0223684 A1* 9/2012 Lim ..... G05F 1/563 323/268
2018/0012556 A1 1/2018 Hsu et al.
2018/0330665 A1* 11/2018 Fujii ..... H01L 27/3262
2019/0035322 A1* 1/2019 Kim ..... H01L 27/1251
2020/0152111 A1* 5/2020 Lim ..... G09G 3/3648
(Continued)

FOREIGN PATENT DOCUMENTS

CN 104700800 6/2015
CN 106098018 11/2016
CN 107610671 1/2018
(Continued)

OTHER PUBLICATIONS

"Office Action of China Counterpart Application", dated Apr. 26, 2022, p. 1-p. 11.

*Primary Examiner* — Chanh D Nguyen
*Assistant Examiner* — Andrew Lee
(74) *Attorney, Agent, or Firm* — JCIPRNET

(57) ABSTRACT

A driving method of display device for a display device capable of reducing flicker due to refresh rate variation includes: determining whether a processor of the display device is generating a vertical blank interval of an image signal, wherein said vertical blank interval is next to a last frame data period thereof, and the last frame data period is for a last frame to be displayed by a display panel; and activating a data line of the display panel with a balancing voltage related to data of a line of the last frame when the processor is generating the vertical blank interval, wherein a plurality of sub-pixels of the display panel connects to the data line, the data of the line of the last frame are sequentially transmitted to the plurality of sub-pixels in the last frame data period for displaying the last frame. Said display device is also disclosed.

8 Claims, 6 Drawing Sheets

(56) References Cited

U.S. PATENT DOCUMENTS

| | | | | |
|---|---|---|---|---|
| 2021/0056908 | A1* | 2/2021 | Park | G09G 3/3275 |
| 2021/0358440 | A1 | 11/2021 | Chen et al. | |

FOREIGN PATENT DOCUMENTS

| | | |
|---|---|---|
| CN | 108877670 | 11/2018 |
| KR | 20090055404 | 6/2009 |
| TW | I622040 | 4/2018 |

* cited by examiner

DISPLAY DEVICE AND DRIVING METHOD THEREOF FOR REDUCING FLICKER DUE TO REFRESH RATE VARIATION

BACKGROUND

1. Technical Field

The disclosure relates to a display device and a driving method of this display device, more particularly to a display device and a driving method for reducing flicker due to refresh rate variation.

2. Related Art

With the need of display devices capable of varying refresh rate frequently for different usages such as for movies, document works, video games etc., the flicker due to refresh rate variation becomes an annoying problem, and more and more display manufacturers are eager to solve this problem for marketing reasons. A reason why there is flicker occurring when the refresh rate of a liquid crystal display (LCD) device changes lies in that the vertical blank interval of the image signal is usually changed for refresh rate variation. Thus, the current leakage time that a thin-film transistor (TFT) of a sub-pixel may have during the vertical blank interval is also changed. This change in the current leakage time leads to different losses in voltage level of the capacitor of liquid crystal (CLC) during the vertical blank interval, thus the flicker occurs.

Specifically, please refer to FIG. 1, which shows a TFT of a sub-pixel, with the drain terminal D thereof connecting to a capacitor of liquid crystal (CLC), the source terminal S thereof connecting to a data line DL, and the gate terminal G thereof connecting to a scan line SL. Sometimes, there can be a storage capacitor (SC) connecting to the CLC in parallel for maintaining the voltage level better. During a frame data period of the image signal, via the TFT, energy provided by the data line DL can be installed into the CLC, as well as the SC if any, as long as the voltage of the scan line SL is high enough to turn on this TFT switch. The CLC is configured to keep the voltage level caused by the installed energy until the scan line SL is high again in the next frame data period. However, during the vertical blank interval between two adjacent frame data periods, the voltage of the data line DL is usually as low as that for the LCD to show black screen. Therefore, since it is impossible for the TFT to act as an ideal transistor, the voltage difference between the drain terminal D and the source terminal S easily leads to a leakage current during the vertical blank interval. Moreover, because the length in time of the vertical blank interval changes when the refresh rate varies, the drops in the voltage level caused by the leakage current differ greatly, resulting in different degrees in brightness decrease, and thus the flicker takes place.

SUMMARY

A driving method of display device configured to be applied to a display device capable of reducing flicker due to refresh rate variation is disclosed according one embodiment of the present disclosure. This driving method includes: determining whether a processor of the display device is generating a vertical blank interval of an image signal, wherein said vertical blank interval is next to a last frame data period of the image signal, and the last frame data period is for a last frame to be displayed by a display panel; and activating a data line of the display panel with a balancing voltage related to data of a line of the last frame when the processor is generating the vertical blank interval, wherein a plurality of sub-pixels of the display panel connects to the data line, the data of the line of the last frame are sequentially transmitted to the plurality of sub-pixels in the last frame data period for displaying the last frame.

A display device capable of reducing flicker due to refresh rate variation is disclosed according another embodiment of the present disclosure. This display device includes: a display panel having a plurality of data lines, a plurality of scan lines, and a plurality of sub-pixels formed at intersections of the data and scan lines; a data line driver coupled to the plurality of data lines; a scan line driver coupled to the plurality of scan lines; a processor configured to receive an input signal and generating an image signal according to the input signal, wherein the image signal comprises a last frame data period and a vertical blank interval next to the last frame data period, and the last frame data period is for the display panel to display a last frame; and a controller coupled to the processor, the data line driver and the scan line driver, wherein the controller determines whether the processor is generating the vertical blank interval and controls the data line driver to activate one of the data line with a balancing voltage when the processor is generating the vertical blank interval, wherein the balancing voltage is related to data of a line of the last frame and said data of the line of the last frame are sequentially sent by the data line activated with the balancing voltage in the last frame data period.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
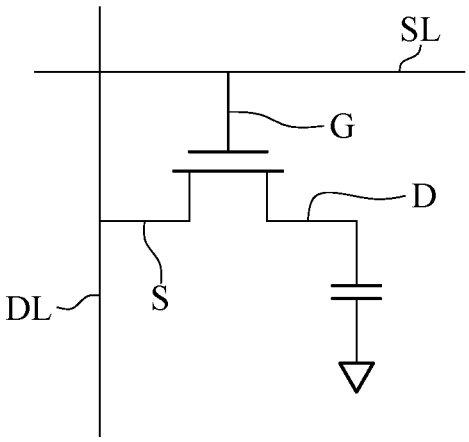
FIG. 1 (PRIOR ART)
FIG. 1 is a simplified diagram illustrating a sub-pixel of a conventional LCD device.
Figure 2:
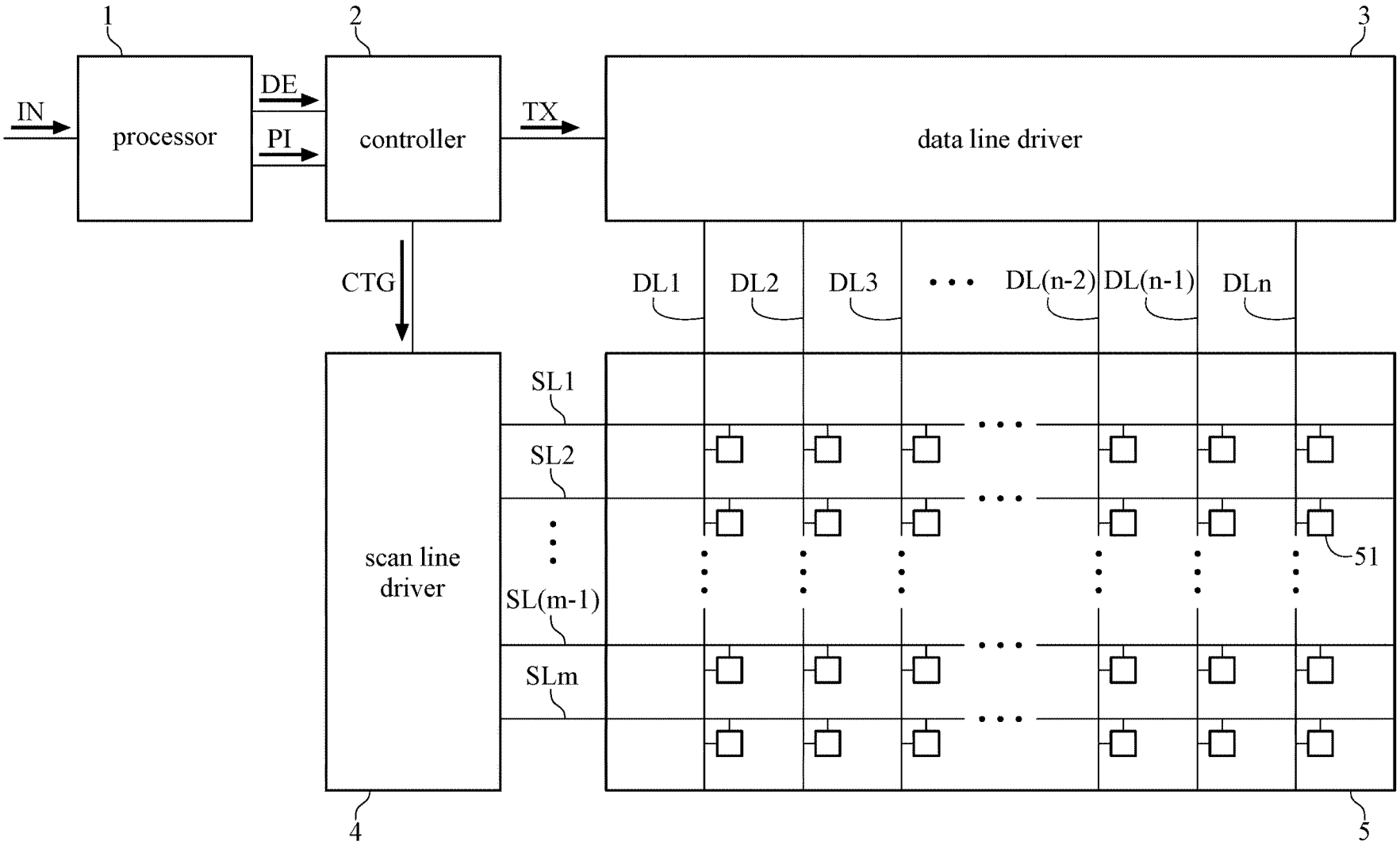
FIG. 2 is a block diagram illustrating a display device capable of reducing flicker due to refresh rate variation according to an embodiment of the present disclosure.

Please refer to FIG. 2, a block diagram illustrating a display device capable of reducing flicker due to refresh rate variation according to an embodiment of the present disclosure. In the display device of this embodiment, there are a processor 1, a controller 2, a data line driver 3, a scan line driver 4 and a display panel 5. The processor 1 receives an input signal IN and controls the data line driver 3 and the scan line driver 4 via the controller 2 so that the display panel 5 can show frames contained in the input signal IN.

Specifically, the processor 1, which may be a processing unit used in a common display device, receives the input signal IN to generate an image signal PI and a data enable signal DE based on the input signal IN, while the data enable signal DE may alternatively be replaced by a vertical sync signal. The image signal PI has a plurality of frame data periods and a plurality of vertical blank intervals interlaced with each other; namely, the frame data periods and the vertical blank intervals are arranged alternately in time. In each of the frame data periods, a frame data is included for the display panel 5 to show a frame corresponding to the frame data. In each of the vertical blank interval, there will be no content to be shown by the display device, and thus signals such as test signals, time codes, closed captioning, teletext, etc. can be sent during this time period. For the following discussion, what will be frequently further referred is one of the plurality of frame data periods, to be identified as "last frame data period," and one of the vertical blank intervals which follows and is next to the last frame data period. Furthermore, the frame to be displayed by the display panel 5 in the last frame data period is identified as "last frame" for the following illustration. Preferably, the vertical blank interval next to the last frame data period is a latest vertical blank interval outputted by the processor 1 at the timing that the driving method of the present disclosure is being performed. In this disclosure, the steps of the driving method applied during the vertical blank interval next to the last frame data period can be applied to each of the plurality of vertical blank intervals while the last frame data period can be any one of the plurality of frame data periods as long as that there is one vertical blank interval next to this frame data period.

The controller 2 shown in FIG. 2 couples to the processor 1 and receives the image signal PI and the data enable signal DE generated thereby, and said controller 2 may be a timing controller of a common display device. According to the image signal PI and the data enable signal DE, the controller 2 generates a transmission signal TX and a control signal CTG for the data line driver 3 and the scan line driver 4 respectively. The transmission signal TX is for controlling the data line driver 3 to actuate the display panel 5 to show the frames corresponding to the frame data in the plurality of frame data periods and for sending out a plurality of post data in the plurality of vertical blank intervals. Specifically, during the vertical blank interval of the image signal PI, although there is no content to be shown by the display panel 5, the controller 2 still outputs the post data for flicker suppression, which will be further illustrated in detail later. The control signal CTG is for controlling the scan line driver 4 to sequentially enable columns of the data of a frame to be installed into the display panel 5 in each of the frame data periods, and to stop the data of the frame to be installed into the display panel 5 in said vertical blank intervals. Moreover, the control signal CTG may be replaced by a horizontal sync signal.

The data line driver 3 couples to the controller 2 and receives the transmission signal TX. Thus, according to the transmission signal TX, the data line driver 3 generates a plurality of series of voltages in the last frame data period as the frame data, and a set of balancing voltages in the vertical blank interval next to the last frame data period as the post data. Each series of voltages corresponds to the data of a respective column of the last frame, and each balancing voltage related to data of a line of the last frame. Specifically, the data line driver 3 may include more than one source driving IC while the number of the source driving ICs depends on the horizontal size of the display panel 5 and the output pins of each source driving IC.

The scan line driver 4 also couples to the controller 2, and the scan line driver 4 receives the control signal CTG from the controller 2. According to the control signal CTG, the scan line driver 4 generates a set of active voltages in the last frame data period and a cutoff voltage in the vertical blank interval nest to the last frame data period. Similarly, the scan line driver 4 may include more than one gate driving IC while the number of the gate driving ICs depends on the vertical size of the display panel 5 and the output pins of each gate driving IC.

The display panel 5 includes a plurality of data lines DL1-DLn, a plurality of scan lines SL1-SLm, and a plurality of sub-pixels 51. The plurality of data lines DL1-DLn connects to the data line driver 3 and receives the plurality of series of voltages and the set of balancing voltages. The plurality of scan lines SL1-SLm connects to the scan line driver 4 and receives the set of active voltages and the cutoff voltage. The plurality of sub-pixels 51 is formed at intersections of the data lines DL1-DLn and the scan lines SL1-SLm. Specifically, each of the sub-pixels 51 connects to a respective one of the data lines DL1-DLn and a respective one of the scan lines SL1-SLm, and the number of the plurality of sub-pixels 51 is m*n. In operation, when the image signal PI sent to the controller 2 is currently during the last frame data period, the plurality of data lines DL1-DLn receives the plurality of series of voltages sequentially, and the plurality of scan lines SL1-SLm receives the set of active voltages, so that each series of voltages corresponding to the data of a respective column of the last frame is installed into the sub-pixels 51 connecting to a respective one of the scan lines SL1-SLm, while said respective one of the scan lines SL1-SLm receives the active voltage and others receive the cutoff voltage. Alternatively, when the image signal PI sent to the controller 2 is currently during the vertical blank interval, the plurality of data lines DL1-DLn receives the set of balancing voltages while all the scan lines SL1-SLm receive the cutoff voltage.

Figure 3:
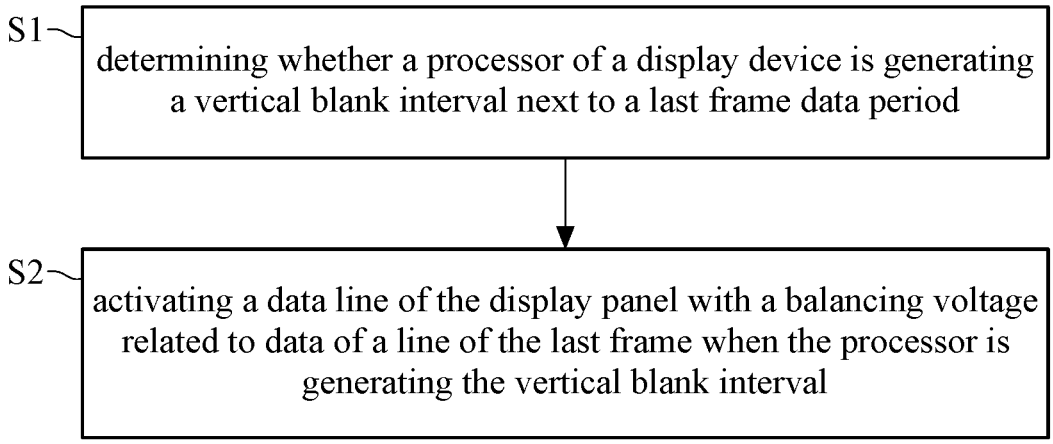
FIG. 3 is a flow chart illustrating the driving method for reducing flicker due to refresh rate variation according to an embodiment of the present disclosure.

Specifically, please also refer to FIG. 3 in addition to FIG. 2, which is a flow chart illustrating the driving method for reducing flicker due to refresh rate variation according to an embodiment of the present disclosure. In step S1, the controller 2 determines whether the processor 1 is generating the vertical blank interval next to the last frame data period. In step S2, the controller 2 controls the data line driver 3 to activate each of the data lines DL1-DLn with a respective balancing voltage once the determination result of step SS1 is positive. During the vertical blank interval, as long as the balancing voltages are set to be higher than the low voltage for the display panel 5 to show the black screen and preferably are close to the voltage levels of the CLCs of the sub-pixels 51, the leakage currents occur in the TFTs of the sub-pixels 51 can be dramatically suppressed. Accordingly, with these balancing voltages applied to the data lines DL1-DLn, a change in the time length of the vertical blank interval should largely affect the voltage levels of the CLCs no more, and thus the flicker due to refresh rate variation can be efficiently suppressed.

Figure 4:
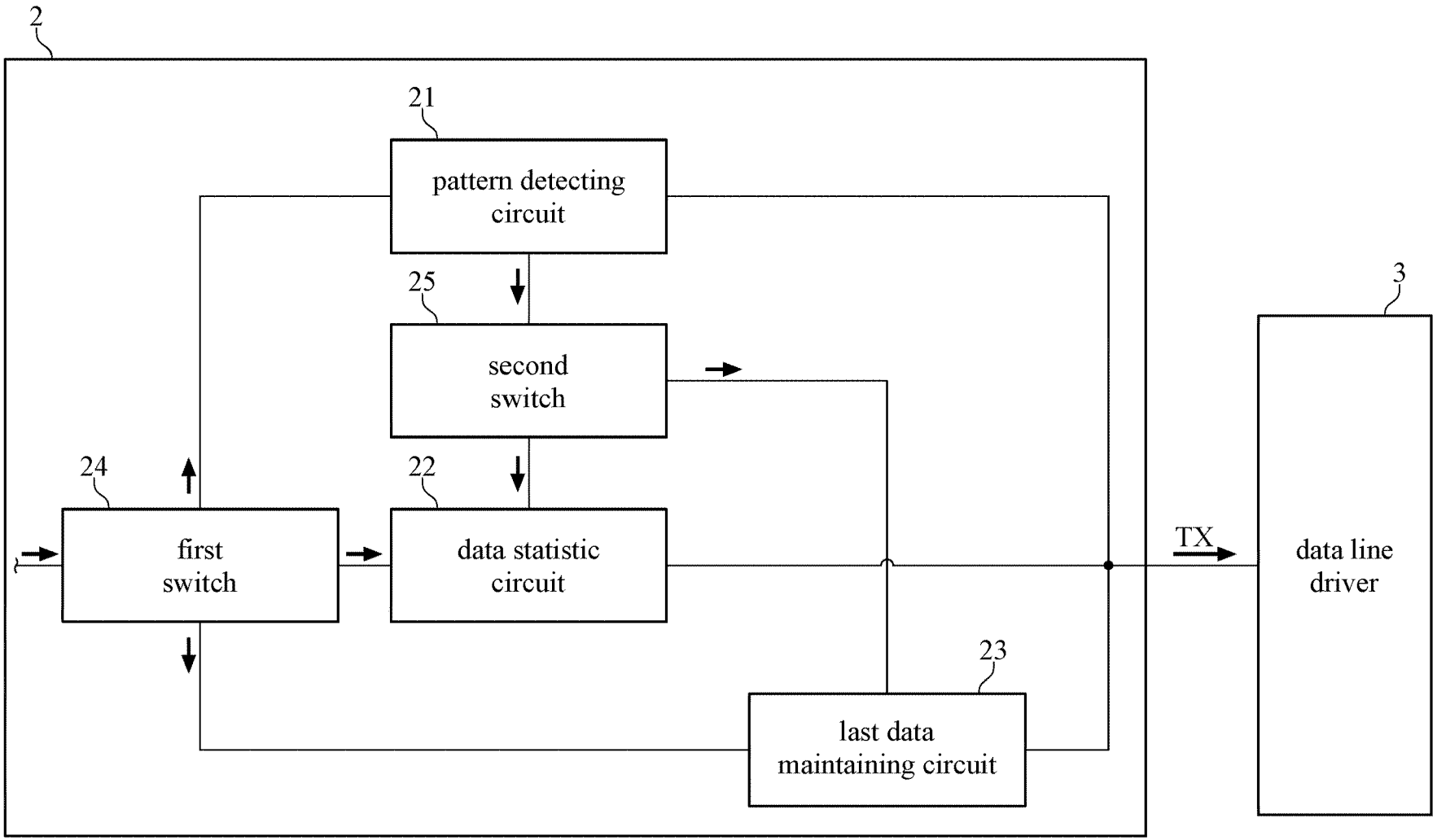
FIG. 4 is a block diagram illustrating an output stage of a controller of the display device according to the embodiment of the present disclosure.

Please refer to FIG. 4, which is a block diagram illustrating an output stage of the controller 2 of the display device according to the embodiment of the present disclosure, especially relating the output stage outputting the transmission signal TX, by which the controller 2 is able to output the post data to the data line driver 3 when the vertical blank interval occurs. In this embodiment, this output stage of the controller 2 includes a pattern detecting circuit 21, a data statistic circuit 22, a last data maintaining circuit 23, a first switch 24, and a second switch 25. However, some of the circuits 21-23 and switches 24, 25 may be omitted in some other embodiments.

The pattern detecting circuit 21 determines whether the last frame matches any one of a set of predetermined display patterns, with every line of a respective one of the predetermined display patterns corresponding to a respective predetermined voltage. When it is determined that the last frame matches one of the predetermined display patterns, the pattern detecting circuit 21 controls the data line driver 3 to activate the data lines DL1-DLn with the predetermined voltages of this predetermined display pattern in the vertical blank interval next to the last frame data period. Namely, the predetermined voltages of this predetermined display pattern are taken as the set of balancing voltages. Accordingly, the set of balancing voltages is ideal for flicker suppression when the last frame matches one of the predetermined display patterns.

The data statistic circuit 22 computes the set of balancing voltages based on the data of the last frame. In the last frame data period, the sub-pixels 51 connecting to the same one of the data lines DL1-DLn jointly show a respective line of the last frame while each of these sub-pixels 51 should receive a voltage and the plurality voltages received by these sub-pixels 51 can charge the CLCs thereof. Therefore, in the vertical blank interval next to the last frame data period, corresponding to the respective line of the last frame in the last frame data period, the data statistic circuit 22 controls the data line driver 3 to activate one of the data lines DL1-DLn with a voltage between the highest one and the lowest one of the plurality of voltages, so as to reduce the differences in voltage between the data lines DL1-DLn and the CLCs. Namely, the voltage between the highest voltage and the lowest voltage is taken as the balancing voltage for this one of the data lines DL1-DLn in the vertical blank interval. Preferably, the voltage serving as the vertical blank interval can be the median, mode or average of the plurality of voltages. Accordingly, the set of balancing voltages can be adaptively generated based on the contents of the last frame.

The last data maintaining circuit 23 activates the data line of the display panel with the voltage of the last one of the data of a respective line of the last frame for each data lines DL1-DLn in the vertical blank interval. This last data maintaining circuit 23 is particularly suitable for a situation that the display panel 5 is controlled to display a single color for the whole screen.

The first switch 24 has an input port configured to receive the data to be sent to the data line driver 3 in the last frame data period, and has three output ports coupling with the pattern detecting circuit 21, the data statistic circuit 22 and the last data maintaining circuit 23 respectively. With a preset selection of the first switch 24, the input port is electrically connecting with one of the output ports, so that the frame data to be sent to the data line driver 3 in the last frame data period can be transmitted to one of the pattern detecting circuit 21, the data statistic circuit 22 and the last data maintaining circuit 23.

The second switch 25 has an input port coupling with the pattern detecting circuit and has two output ports coupling with the data statistic circuit 22 and the last data maintaining circuit 23 respectively. Based on a preset selection of the second switch 25, the input port thereof is electrically connected with one of the output ports thereof, so that the frame data to be sent to the data line driver 3 in the last frame data period can be transmitted to one of the data statistic circuit 22 and the last data maintaining circuit 23 when the pattern detecting circuit 21 determines that the last frame matches none of the predetermined display patterns.

Figure 5:
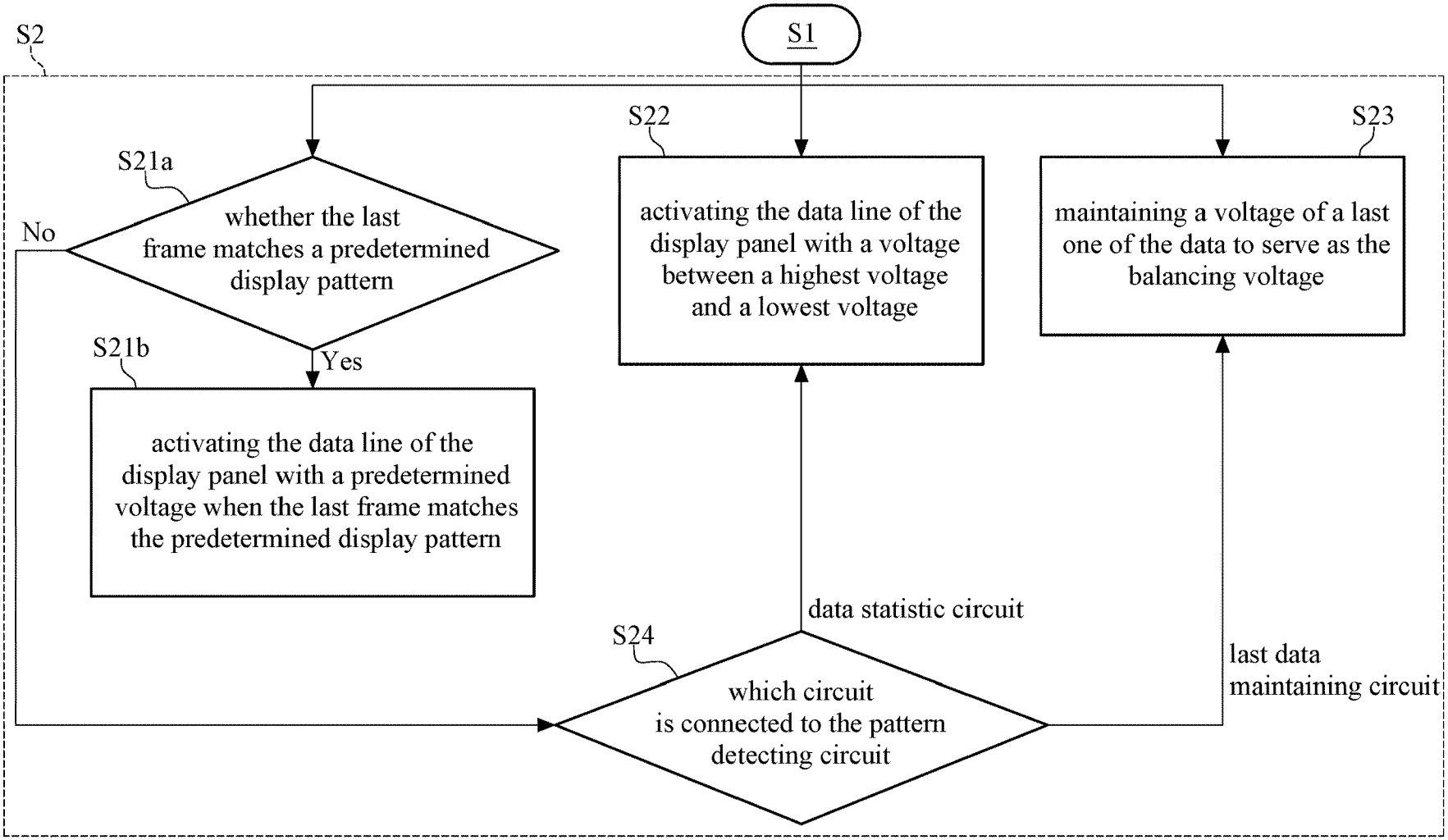
FIG. 5 is a detailed flow chart illustrating a later part of the driving method according to the embodiment of the present disclosure.

Please further refer to FIG. 5 in addition to FIG. 4, which shows a flow chart illustrating the details of the step S2 of the driving method according to the embodiment of the present disclosure. When the controller 2 controls the data line driver 3 to activate each of the data lines DL1-DLn with a respective balancing voltage, either one of the pattern detecting circuit 21, the data statistic circuit 22, and the last data maintaining circuit 23 can be applied to control the data line driver 3 to generate the balancing voltages. Specifically, when the input port of the first switch 24 is electrically connected to the output port coupling with the pattern detecting circuit 21, a step S21*a*, "determining whether the last frame matches a predetermined display pattern," is performed while this predetermined display pattern can be any one in the set of predetermined display patterns. A step S21*b*, "activating the data line of the display panel 5 with a predetermined voltage serving as the balancing voltage when the last frame matches the predetermined display pattern," will be performed for each of the data lines DL1-DLn when the determination result of the step S21*a* is positive.

When the input port of the first switch 24 is electrically connected to the output port coupling with the data statistic circuit 22, the controller 2 performs a step S22, "activating the data line of the display panel 5 with a voltage between the highest voltage and the lowest voltage of a plurality of voltages corresponding to the data of the line of the last frame," for each of the data lines DL1-DLn during the vertical blank interval. For example, said voltage between the highest voltage and the lowest voltage and serving as the balancing voltage can be the median, mode or average of the plurality of voltages.

Similarly, when the input port of the first switch 24 is electrically connected to the output port coupling with the last data maintaining circuit 23, the controller 2 performs a step S23, "activating the data line of the display panel 5 with a voltage of a last one of the data of the line of the last frame," for each of the data lines DL1-DLn during the vertical blank interval, so that the voltage of the last one of the data of the line of the last frame serves as the balancing voltage.

A step S24, "determining which circuit of the data statistic circuit 22 and the last data maintaining circuit 23 is connected to the pattern detecting circuit 21," is performed when the determination result of the step S21*a* is negative, that is, the last frame matches none of the predetermined display patterns. Specifically, the determination result of the step S24 depends on the preset selection of the second switch 25. If the input port of the second switch 25 electrically connects to the output port coupling with the data statistic circuit 22, the step S22 is performed after the step S24; if the input port of the second switch 25 electrically connects to the output port coupling with the last data maintaining circuit 23, the step S23 is performed after the step S24.

Although it is shown in FIG. 4 that the controller 2 includes circuits 21-23 and switches 24-25, the controller 2 may have the data statistic circuit 22 or the last data maintaining circuit 23 only. For the same reason, the sub-steps of the step S2 may include the step S22 or the step S23 only.

Figure 6:
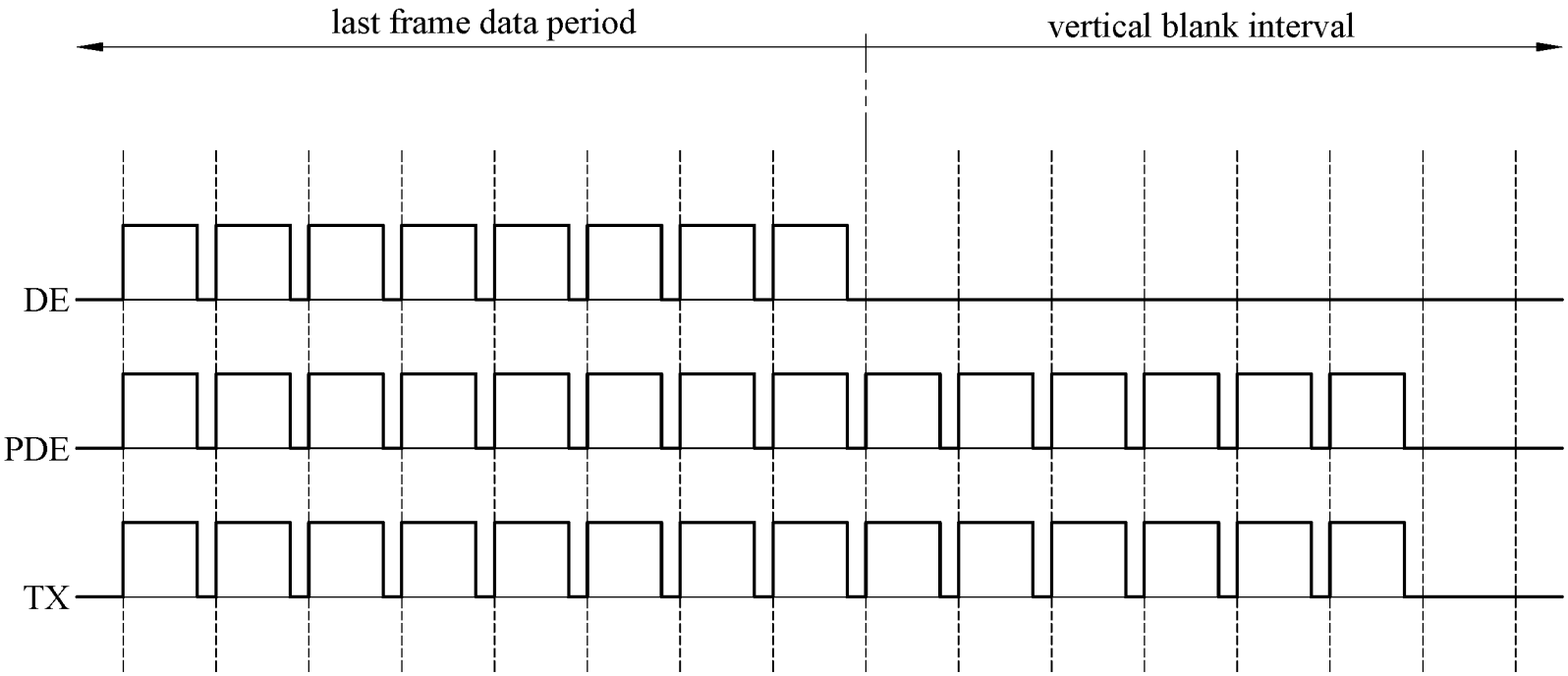
FIG. 6 is a voltage chart illustrating the signals transmitted in the display device according to the embodiment of the present disclosure.

Please further refer to FIG. 6. It is a voltage chart briefly illustrating the signals transmitted in the display device according to the embodiment of the present disclosure. Please refer to FIG. 6 as well as FIG. 2. The data enable signal DE generated by the processor 1 includes a plurality of square waves for the controller 2 to generate the frame data accordingly in the last frame data period, and there will be no content in the vertical blank interval. However, after the controller 2 receives the image signal PI and the data enable signal DE, the controller 2 changes the data enable signal DE to a processed data enable signal PDE that there are square waves not only in the last frame data period but also in the vertical blank interval. With this processed data enable signal PDE, the controller 2 can continuously output the transmission signal TX including the frame data in the frame data periods and the post data in the vertical blank intervals.

In view of the foregoing descriptions, by implementing the driving method disclosed in the present disclosure, the voltage differences between the CLCs and the data lines DL1-DLn in the vertical blank intervals are decreased. Thus, for every CLC of the display panel 5, the difference between the leakage current in a vertical blank interval before a change in refresh rate and the leakage current in another vertical blank interval after the change in refresh rate can be extremely small. Accordingly, flickers due to refresh rate variation are efficiently reduced since the energy losses of the CLC in vertical blank intervals before and after said change in refresh rate are similar to each other.

What is claimed is:

1. A driving method of display device, configured to be applied to a display device capable of reducing flicker due to refresh rate variation, with the driving method comprising:

determining whether a processor of the display device is generating a vertical blank interval of an image signal, wherein said vertical blank interval is next to a last frame data period of the image signal, and the last frame data period is for a last frame to be displayed by a display panel; and activating a data line of the display panel with a balancing voltage related to data of a line of the last frame when the processor is generating the vertical blank interval, wherein a plurality of sub-pixels of the display panel connects to the data line, the data of the line of the last frame are sequentially transmitted to the plurality of sub-pixels in the last frame data period for displaying the last frame, wherein the balancing voltage is set to be higher than a low voltage for the display panel to show a black screen, wherein activating the data line of the display panel with the balancing voltage related to the data of the line of the last frame comprises:

determining whether the last frame matches a predetermined display pattern; and activating the data line of the display panel with a predetermined voltage serving as the balancing voltage when the last frame matches the predetermined display pattern.

2. The driving method of display panel according to claim 1, wherein activating the data line of the display panel with the balancing voltage related to the data of the line of the last frame comprises:

when the last frame does not match the predetermined display pattern, maintaining a voltage of a last one of the data to serve as the balancing voltage, or, with the data of the line of the last frame corresponding to a plurality of voltages having a highest voltage and a lowest voltage, activating the data line of the display panel with a voltage between the highest voltage and the lowest voltage and serving as the balancing voltage.

3. A display device capable of reducing flicker due to refresh rate variation, comprising:

a display panel having a plurality of data lines, a plurality of scan lines, and a plurality of sub-pixels formed at intersections of the data and scan lines;

a data line driver coupled to the plurality of data lines;

a scan line driver coupled to the plurality of scan lines;

a processor configured to receive an input signal and generating an image signal according to the input signal, wherein the image signal comprises a last frame data period and a vertical blank interval next to the last frame data period, and the last frame data period is for the display panel to display a last frame; and a controller coupled to the processor, the data line driver and the scan line driver, wherein the controller determines whether the processor is generating the vertical blank interval and controls the data line driver to activate one of the data line with a balancing voltage when the processor is generating the vertical blank interval, wherein the balancing voltage is related to data of a line of the last frame and said data of the line of the last frame are sequentially sent by the data line activated with the balancing voltage in the last frame data period, wherein the balancing voltage is set to be higher than a low voltage for the display panel to show a black screen, wherein the controller comprises a pattern detecting circuit for determining whether the last frame matches a predetermined display pattern, and the controller controls the data line driver to activate the data line with a predetermined voltage serving as the balancing voltage when the pattern detecting circuit determines the last frame matches the predetermined display pattern.

4. The display device capable of varying a refresh rate thereof according to claim 3, wherein the data of the line of the last frame correspond to a plurality of voltages having a highest voltage and a lowest voltage, the controller further comprises a data statistic circuit connecting with the pattern detecting circuit, the pattern detecting circuit further determines whether the last frame matches other predetermined display patterns, and wherein, when the pattern detecting circuit determines the last frame matches none of the predetermined display patterns, the controller, via the data statistic circuit, controls the data line driver to activate the data line of the display panel with a voltage between the highest voltage and the lowest voltage and serving as the balancing voltage.

5. The display device capable of varying a refresh rate thereof according to claim 3, wherein the controller further comprises a last data maintaining circuit connecting with the pattern detecting circuit, the pattern detecting circuit further determines whether the last frame matches other predetermined display patterns, and wherein, when the pattern detecting circuit determines the last frame matches none of the predetermined display patterns, the controller, via the last data maintaining circuit, controls the data line driver to maintaining a voltage of a last one of the data of the line of the last frame to serve as the balancing voltage.

6. The display device capable of varying a refresh rate thereof according to claim 3, wherein the controller further comprises a switch, a data statistic circuit and a last data maintaining circuit, and the switch has an input port connecting to the pattern detecting circuit and two output ports connecting to the data statistic circuit and the last data maintaining circuit respectively, the pattern detecting circuit further determines whether the last frame matches other predetermined display patterns, and wherein, when the pattern detecting circuit determines the last frame matches none of the predetermined display patterns, the controller, via the data statistic circuit, controls the data line driver to activate the data line of the display panel with a voltage between a highest voltage and a lowest voltage and serving as the balancing voltage, or, via the last data maintaining circuit, controls the data line driver to maintaining a voltage of a last one of the data of the line of the last frame to serve as the balancing voltage, wherein the data of the line of the last frame correspond to a plurality of voltages having the highest voltage and the lowest voltage.

7. A driving method of display device, configured to be applied to a display device capable of reducing flicker due to refresh rate variation, with the driving method comprising:

determining whether a processor of the display device is generating a vertical blank interval of an image signal, wherein said vertical blank interval is next to a last frame data period of the image signal, and the last frame data period is for a last frame to be displayed by a display panel; and activating a data line of the display panel with a balancing voltage related to data of a line of the last frame when the processor is generating the vertical blank interval, wherein a plurality of sub-pixels of the display panel connects to the data line, the data of the line of the last frame are sequentially transmitted to the plurality of sub-pixels in the last frame data period for displaying the last frame, wherein activating the data line of the display panel with the balancing voltage related to the data of the line of the last frame comprises:

maintaining a voltage of a last one of the data to serve as the balancing voltage during the vertical blank interval.

8. A display device capable of reducing flicker due to refresh rate variation, comprising:

a display panel having a plurality of data lines, a plurality of scan lines, and a plurality of sub-pixels formed at intersections of the data and scan lines;

a data line driver coupled to the plurality of data lines;

a scan line driver coupled to the plurality of scan lines;

a processor configured to receive an input signal and generating an image signal according to the input signal, wherein the image signal comprises a last frame data period and a vertical blank interval next to the last frame data period, and the last frame data period is for the display panel to display a last frame; and a controller coupled to the processor, the data line driver and the scan line driver, wherein the controller determines whether the processor is generating the vertical blank interval and controls the data line driver to activate one of the data line with a balancing voltage when the processor is generating the vertical blank interval, wherein the balancing voltage is related to data of a line of the last frame and said data of the line of the last frame are sequentially sent by the data line activated with the balancing voltage in the last frame data period, wherein the controller comprises a last data maintaining circuit for activating the data line of the display panel with a voltage of a last one of the data of the line of the last frame to serve as the balancing voltage during the vertical blank interval.

* * * * *